United States Patent [19]

Gossalter

[11] 4,373,580

[45] Feb. 15, 1983

[54] TUBE SEALING IN TUBE BUNDLE HEAT EXCHANGERS

[76] Inventor: Rene Gossalter, P.O. Box 715, St. Gallen, Switzerland

[21] Appl. No.: 243,034

[22] Filed: Mar. 12, 1981

Related U.S. Application Data

[63] Continuation of Ser. No. 10,756, Feb. 9, 1979, abandoned.

[30] Foreign Application Priority Data

Feb. 13, 1978 [CH] Switzerland ..... 1539/78

[51] Int. Cl.[3] ..... F28F 9/04

[52] U.S. Cl. ..... 165/173; 165/175

[58] Field of Search ..... 165/81-83, 165/173, 175

[56] References Cited

U.S. PATENT DOCUMENTS

| | | | |
|---|---|---|---|
| 2,196,683 | 4/1940 | Pickstone | 165/173 |
| 2,607,567 | 8/1952 | Hobbs | 165/81 |
| 2,762,611 | 9/1956 | Monroe et al. | 165/173 X |
| 2,859,948 | 11/1958 | Callard | 165/173 |
| 3,185,210 | 5/1965 | Kuhne et al. | 165/173 |

FOREIGN PATENT DOCUMENTS

| | | | |
|---|---|---|---|
| 191441 | 10/1956 | Fed. Rep. of Germany | 165/173 |
| 292913 | 8/1953 | Switzerland | 165/173 |

*Primary Examiner*—William R. Cline
*Assistant Examiner*—Theophil W. Streule, Jr.
*Attorney, Agent, or Firm*—Sixbey, Friedman & Leedom

[57] ABSTRACT

A tube-bundle heat exchanger which allows replacement of the tubes. The heat exchanger tubes are held and sealed into a replaceable sealing arrangement consisting of an elastic sealing tube plate and two rigid tube plates arranged on either side which press the elastic sealing tube plate in the axial direction sealing the tubes. Force may be transmitted to the rigid tube plates by external means or by operating pressure of the media flowing in the heat exchanger.

9 Claims, 3 Drawing Figures

TUBE SEALING IN TUBE BUNDLE HEAT EXCHANGERS

This application is a continuation of application Ser. No. 010,756, filed 2/9/79, now abandoned.

The present invention relates to a tube-bundle heat exchanger in which the heat-exchanger tubes can be replaced at any time.

Previously, the heat-exchanger tubes have been fixedly welded or pressed into what are termed tube plates.

In tube bundle heat exchangers, substances are often heated or cooled which corrode the tube walls and/or leave deposits on their surfaces.

There exist materials, from which heat exchanger tubes can be manufactured, that withstand the majority of corrosive attacks, e.g. carbon tubes, glass tubes or titanium tubes, which can in practice be joined to tube plates by welding or pressing in only with difficulty or not at all.

Heat exchanger tubes of these materials can be built into tube bundle heat exchangers according to the invention just as easily as heat exchanger tubes of steel.

In tube bundle heat exchangers according to the invention the heat exchanger tubes are held and sealed into a replaceable sealing arrangement consisting of an elastic sealing tube plate and two rigid tube plates arranged on either side, which press the elastic sealing tube plate in the axial direction.

The rigid tube plates are mounted in housing portions in such a manner that the force for the pressing of the elastic sealing tube plate may be transmitted to the rigid tube plates by external opposed forces on the housing portions and so that this force is additionally influenced by the pressure of the media.

Figure 1:
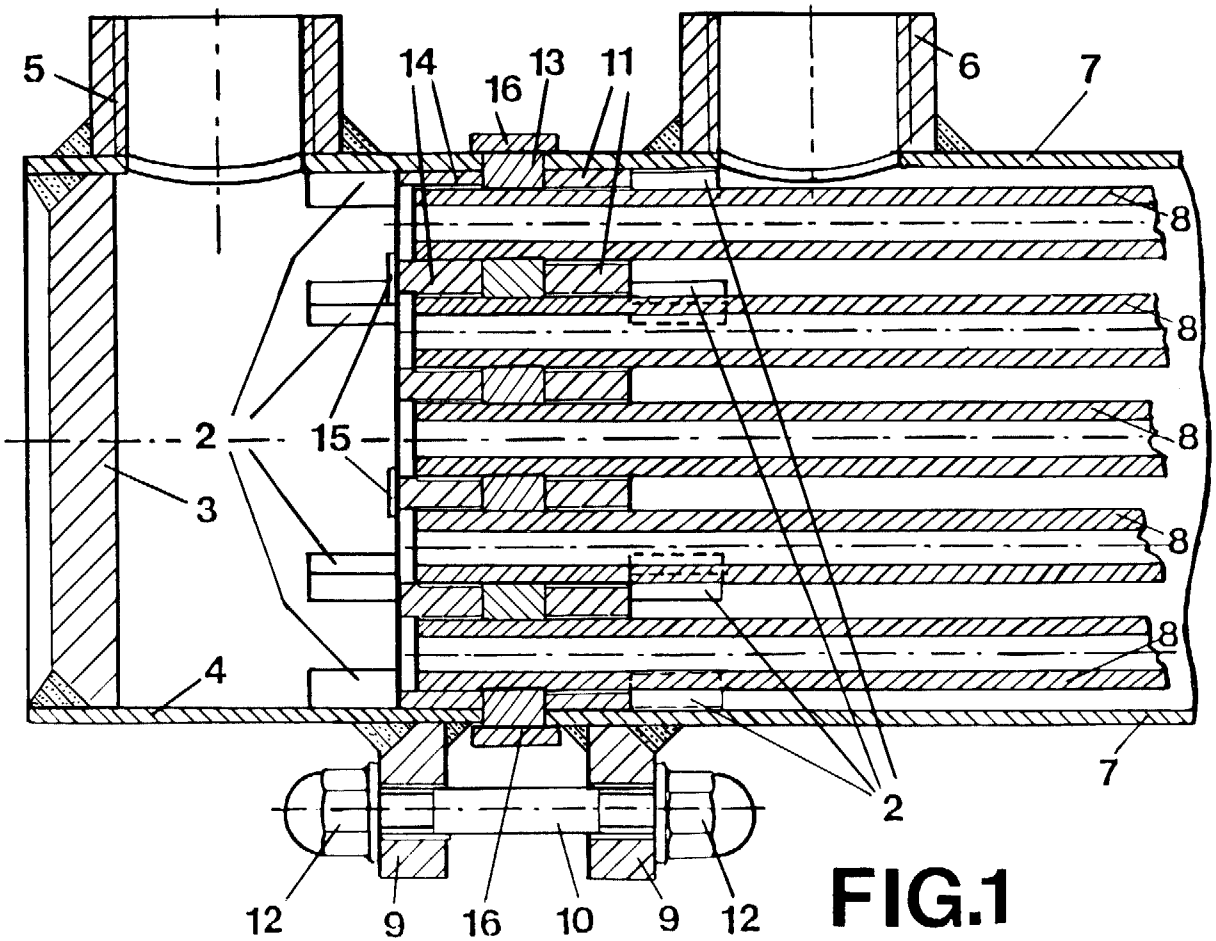
Figure 3:
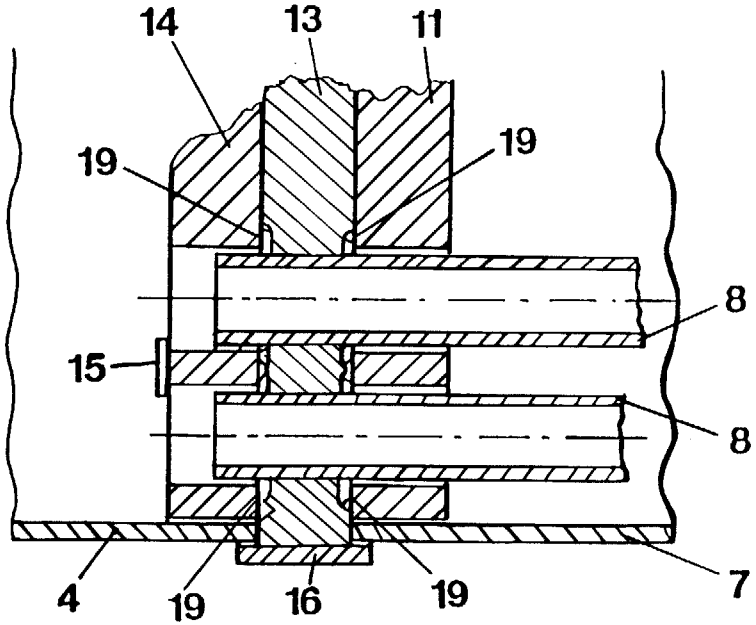
Figure 2:
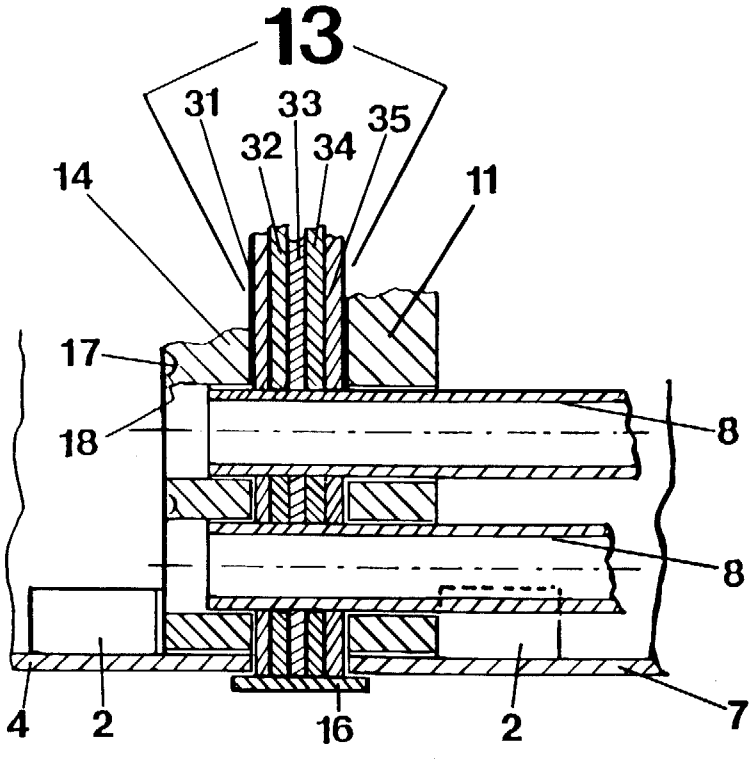

An exemplary embodiment of a tube bundle heat exchanger in accordance with the invention is represented in FIGS. 1, 2 and 3.

FIG. 1 represents a longitudinal section of an end connection of a tube bundle heat exchanger in accordance with the invention with a housing of welded construction.

In FIG. 2 there is shown a particular form of construction of the elastic sealing tube plate.

FIG. 3 shows an additional application of sealing rings.

The connection 6 for the entrance and exit of the medium that flows in the outer space of the tube bundle heat exchanger around the heat exchanger tubes 8, is welded directly to the jacket tube 7.

The jacket tube 7 contains a plurality of abutments 2 that support a replaceable rigid tube plate 11.

On the jacket tube 7 there are welded a plurality of screw brackets 9 uniformly distributed about the circumference.

The extension tube 4 carries the connecting sleeve 5, through which the medium, that flows in the exchanger tubes, enters or leaves.

The extension tube 4 is closed outwardly by the cover 3 and contains a plurality of abutments 2 to support the replaceable tube plate 14.

The extension tube 4 possesses several screw brackets 9 distributed uniformly about the circumference.

By means of the nuts 12, the tension screws 10 draw the extension tube 4 axially towards the jacket tube 7, so that the elastic sealing tube plate 13 is pressed by the rigid tube plates 11 and 14 by way of the abutments 2.

The elastic sealing tube plate 13 is completely enclosed, in point of fact by the faces of the rigid tube plates 11 and 14 the end faces of the jacket tube 7 and of the extension tube 4 and radially by the sleeve 16.

The elastic material of the elastic sealing tube plate 13 thus cannot yield and presses with the same pressure against all the surfaces present, such as the faces of the tube plates, the end faces of the extension tube 4 and of the jacket tube 7, the internal surface of the sleeve 16 and also against the surfaces of the heat exchanger tubes 8.

Reliable outward sealing between the media is thus attained.

The annular gap between the inserted rigid tube plate 14 and the extension tube 4 is reliably sealed by the pressure of the elastic sealing tube plate 13 against the end face of the extension tube and the face of the tube plate 14.

The annular gap between the inserted rigid tube plate 11 and the jacket tube 7 is reliably sealed by the pressure of the elastic sealing tube plate 13 against the end face of the jacket tube 7 and the face of the tube plate 11.

The small rods 15 fitted to the rigid tube plate 14 in FIGS. 1 and 3 prevent the heat exchanger tubes 8 from slipping through the rigid tube plate 14.

In FIG. 2 there is illustrated another manner of preventing the heat exchanger tubes from slipping through.

An indentation 17 produced by means of a punch or chisel gives rise to a corresponding protrusion 18 in the bore for the heat exchanger tube 8.

Division of the elastic tube sealing plate 13 into several layers makes sealing possible even against very high working pressures and media of low surface tension. The layers may consist of the same or of different materials.

In this example the elastic sealing tube plate 13 consists of five layers 31, 32, 33, 34 and 35, of which the material characteristics of each layer in respect of elasticity, constancy with temperature and corrosion resistance varies.

The lamination of the elastic sealing tube plate 13 enables a plurality of sealing locations, one behind another on the surface of the heat exchanger tubes 8, to be attained.

The relatively thin sealing layers may be stamped out.

Manufacture is cheapened as compared with the solid sealing tube plate 13 and the mounting of the individual layers is simpler for close tolerances, than for the solid sealing tube plate.

FIG. 3 shows the employment of sealing rings 19 in combination with an elastic sealing tube plate 13 and the rigid tube plates 11 and 14 on either side.

Sealing rings 19 in accordance with the invention make reliable sealing between the media possible even with large tolerances between the bores in the rigid tube plates 11 and 14 and the external diameter of the heat exchanger tubes 8.

In tube bundle heat exchangers in accordance with the invention the rigid tube plates 11 and 14 are inserted and may be axially displaced against the elastic sealing tube plate 13. The operating pressure of the media flowing in the tube bundle heat exchanger thus assists the pressure against the elastic sealing tube plate 13.

Owing to the easy replaceability of all the tube plates different arrangements of heat exchanger tubes may be constructed in the same housing.

The possibility of laying the outer space completely in tube bundle heat exchangers in accordance with the invention facilitates examination and cleaning.

Replaceability of the tube plates provides a rationalisation in stock-keeping and in production, as well as the possibility of adapting already installed heat exchangers in accordance with the invention to altered requirements.

What I claim is:

1. A tube bundle heat exchanger comprising a generally tubular housing including a jacket tube and an extension tube extending substantially coaxially with said jacket tube, said jacket and extension tubes having adjacent open ends relatively spaced apart, sealing means including an elastic sealing tube plate mounted in the space between said jacket and extension tubes and extending transversely thereof, a first rigid tube plate mounted within said extension tube in contact with said elastic tube plate and extending substantially parallel thereto, a second rigid tube plate mounted within said jacket tube in contact with said elastic tube plate and extending substantially parallel thereto, mounting means on at least one of said jacket and extension tubes for mounting at least one of said first and second rigid tube plates for movement axially of said jacket and extension tubes toward said elastic sealing tube plate, said mounting means including abutment means extending from the inner surfaces of at least one of said jacket and extension tubes for engaging the respective surface of the axially movable rigid tube plate which is opposite the surface thereof in contact with said elastic sealing tube plate, a plurality of heat exchanger tubes extending in spaced relationship axially of said jacket and extension tubes through aligned apertures formed in said first and second rigid tube plates and said elastic sealing tube plate, one end of each of said heat exchanger tubes opening into said extension tube, tube retaining means formed on said first rigid tube plate for retaining said heat exchanger tubes within said first rigid tube plate, circumferential sleeve means extending around the adjacent spaced ends of said extension and jacket tubes and over an annular gap therebetween to enclose said elastic tube plate, said sleeve means being formed to permit relative axial movement of said jacket and extension tubes, and a plurality of force applying means connected between said jacket and extension tubes and operative to move the spaced open ends thereof toward one another to cause axial movement of said first and second rigid tube plates against opposite sides of said elastic sealing tube plate and expansion of said elastic sealing tube plate against said heat exchanger tubes and the adjacent open ends of said extension and jacket tubes to enhance the sealing of said annular gap.

2. The tube bundle heat exchanger of claim 1, wherein first fluid conduit means are provided in said extension tube to provide fluid to the extension tube and said heat exchanger tubes, and second fluid conduit means are provided in said jacket tube to provide fluid to the jacket tube for contact with the exterior of said heat exchanger tubes.

3. The tube bundle heat exchanger of claim 2, wherein said mounting means is formed on both said jacket and said extension tube and operates to mount both said first and second rigid tube plates for axial movement, said heat exchanger tubes terminating within said first rigid tube plate in spaced relation to the surface thereof which is opposite to the surface in contact with said elastic sealing tube plate.

4. The tube bundle heat exchanger of claim 3 wherein said tube retainer means includes a plurality of rods secured to the surface of said first rigid tube plate on the side thereof opposite said elastic sealing tube plate, said rods each having at least one end which extends over the open end of a heat exchanger tube to retain said heat exchanger tube within said first rigid tube plate.

5. The tube bundle heat exchanger of claim 3 wherein said tube retainer means includes at least one projection for each heat exchanger tube formed in said first rigid tube plate and extending over the open end of a heat exchanger tube to retain said heat exchanger tube within said first rigid tube plate.

6. The tube bundle heat exchanger of claim 3, wherein said elastic sealing tube plate includes a laminar arrangement of elastic materials.

7. The tube bundle heat exchanger of claim 3, wherein said force applying means includes screw brackets attached to the outer surfaces of said jacket tube and extension tube so that said extension tube can be axially pressed toward said jacket tube.

8. The tube bundle heat exchanger of claim 6, wherein the laminar arrangement forming said elastic sealing tube plate includes layers of elastic sealing material of different elasticity.

9. The tube bundle heat exchanger of claim 3, wherein annular sealing rings are disposed about the circumference of each heat exchanger tube so as to extend between said elastic tube plate and said first and second rigid tube plates respectively.

* * * * *